United States Patent [19]

On, Jr.

[11] Patent Number: 4,465,606

[45] Date of Patent: Aug. 14, 1984

[54] STABILIZATION OF HYDROCARBON OIL

[75] Inventor: Harry P. On, Jr., La Habra, Calif.

[73] Assignee: Union Oil Company of California, Los Angeles, Calif.

[21] Appl. No.: 400,722

[22] Filed: Jul. 22, 1982

[51] Int. Cl.[3] ..... C10M 1/26

[52] U.S. Cl. ..... 252/56 R; 208/95; 208/18; 208/19

[58] Field of Search ..... 252/33, 42.7, 51.5 A, 252/56 R; 208/95, 18, 19

[56] References Cited

U.S. PATENT DOCUMENTS

| | | | |
|---|---|---|---|
| 2,697,033 | 12/1954 | Ambrose et al. | 44/68 |
| 2,924,617 | 2/1960 | Wright | 260/505 |
| 3,018,250 | 1/1962 | Anderson et al. | 252/51.5 |
| 3,018,291 | 1/1962 | Anderson et al. | 260/326.5 |
| 3,024,195 | 3/1962 | Drummond et al. | 252/51.5 |
| 3,133,019 | 5/1964 | Otto et al. | 252/33 |
| 3,154,560 | 10/1964 | Osuch | 260/326.3 |
| 3,240,696 | 3/1966 | Halik et al. | 208/19 |
| 3,277,004 | 10/1966 | Schiff | 252/33 |
| 3,671,423 | 6/1972 | MacDonald et al. | 208/97 |
| 3,781,196 | 12/1973 | Thompson | 208/96 |
| 3,969,234 | 7/1976 | Schiff | 252/33 |
| 4,036,770 | 7/1977 | Espenschied et al. | 252/51.5 |
| 4,264,461 | 4/1981 | Chao et al. | 252/50 |
| 4,328,111 | 5/1982 | Watson et al. | 252/33.4 |

*Primary Examiner*—Jacqueline V. Howard

*Attorney, Agent, or Firm*—Denton L. Anderson; Yale S. Finkle; Dean Sandford

[57] ABSTRACT

Hydroprocessed hydrocarbon compositions are inhibited or prevented from forming sediment upon exposure to light by the addition of chemical additives. These sediment inhibiting additives are polyalkenylsuccinimides, calcium sulfonates, metal phenates, polyol esters, and mixtures thereof.

28 Claims, No Drawings

STABILIZATION OF HYDROCARBON OIL

BACKGROUND OF THE INVENTION

This invention relates to the stabilization of hydrocarbons against light-induced sedimentation. The invention is particularly directed to additives useful in preventing or resisting hydrocarbon degradation due to exposure to actinic energy, and is more particularly directed to the stabilization of hydrocarbon liquids which have been subjected to hydroprocessing. Most particularly, the invention is directed to stabilizing base lubricating oils and fuel oils obtained from hydroprocessed feedstocks, and especially from hydroprocessed shale oils or fractions thereof.

It has been the practice to prepare lubricating oils and fuel oils from various hydrocarbon crude sources by fractional distillation. More recently, lubricating oils have been produced by hydroprocessing crude oils and distilling the resulting product. Unfortunately, lubricating oil fractions produced by hydroprocessing suffer from a shortcoming in that they are unstable when exposed to light. Specifically, when exposed to sunlight or ultraviolet radiation, a brown precipitate forms. Such a precipitate is undesirable, not only because it may prove detrimental to the lubrication function which the oil is to perform, but also because it reduces the aesthetic value of what would otherwise be a clear premium quality oil.

The patent literature has recognized the need to stabilize hydrocarbon compositions with respect to reaction-inducing environmental factors. U.S. Pat. No. 3,671,423 issued to MacDonald et al. discloses stabilizing lubricating oils to light and air by percolating the oil through silica-alumina gels containing a Y-type molecular sieve. U.S. Pat. No. 3,781,196 issued to Thompson discloses a process for the production of a stabilized lubricant oil by serially extracting a hydrocracked lube oil with furfural. U.S. Pat. No. 4,264,461 issued to Chao et al. discloses a process for stabilizing hydrocracked lubricating oils to deterioration induced by light by the addition of certain substantially aliphatic amine components.

Presently, the conversion to alternative energy sources has increased the need to prevent light-induced sediment formation. Shale oil is one of the most promising alternative sources of energy for the future. Yet, the chemical and physical nature of shale oil mandates that it be subjected to hydroprocessing, resulting in products severely limited in usefulness due to rapid formation of sediment. The acuteness of the sedimentation problem is demonstrated by the fact that a typical hydroprocessed syncrude derived from shale oil forms a noticeable sediment upon exposure to sunlight within just two days.

The problems caused by this rapid, light-induced sediment formation are manifold. In a lubricating oil a drastic deterioration results, so as to shorten the useful life of the oil. Similarly, fuels such as automotive gasoline derived from shale oil syncrude rapidly form sediment upon exposure to light. Such sediments severely foul the mechanical elements of an internal combustion engine and contribute to preignition, cause valve burning, and tend to increase octane requirements.

In view of the foregoing, one object of this invention is to inhibit or prevent light-induced sediment formation in hydroprocessed liquid hydrocarbons.

Another object of this invention is to stabilize shale oil-derived hydroprocessed liquid hydrocarbons to light-induced sediment formation.

Another object of this invention is to stabilize lubricating oils produced by hydroprocessing against light-induced sediment formation.

Yet another object of this invention is to stabilize fuel oils produced by hydroprocessing against light-induced sediment formation.

These and other objects and advantages of the invention will become apparent in view of the following description of the invention.

SUMMARY OF THE INVENTION

In accordance with the present invention, a composition of matter is provided in which sediment formation is inhibited or prevented, the composition comprising a hydroprocessed liquid hydrocarbon and one or more stabilizing additives selected from the group consisting of calcium sulfonates, metal phenates, polyalkenylsuccinimides, and polyol esters. In another embodiment of the invention, a method is provided for stabilizing a hydroprocessed lubricating oil against light-induced sediment formation wherein the oil is combined with one or more additives selected from the group consisting of calcium sulfonates, metal phenates, polyalkenylsuccinimides, and polyol esters.

DETAILED DESCRIPTION OF THE INVENTION

In accordance with this invention, hydroprocessed liquid hydrocarbons are inhibited or prevented from forming sediment induced by sunlight or other source of actinic radiation by the addition of one or more additives selected from the group consisting of calcium sulfonates, metal phenates, polyalkenylsuccinimides, and polyol esters.

As used herein, the term "hydroprocessing" relates to those processes wherein a hydrocarbon fluid is reacted with hydrogen, often at elevated temperature and pressure and in the presence of an appropriate catalyst. One form of hydroprocessing is hydrotreating, a process having as its primary object the removal of sulfur and/or nitrogen from a hydrocarbon fluid by conversion thereof to hydrogen sulfide and ammonia, respectively. When the emphasis in hydrotreating is on sulfur removal, then the process is often referred to as hydrodesulfurization, and when nitrogen removal is the emphasized goal, then the term hydrodenitrogenation is employed. Another type of hydroprocessing is hydrocracking, a process for cracking hydrocarbons and saturating the cracked products by reaction with hydrogen to yield a hydrocarbon product of lower average molecular weight than that of the feed. In the usual case, the hydrocracking is indiscriminate, with both complex organic molecules as well as paraffins being hydrocracked, but in one form of hydrocracking, known as hydrodewaxing, the main object is to selectively crack straight and slightly branched paraffin molecules, usually so that the resulting product is of substantially reduced pour point. Yet other forms of hydroprocessing are known, as for example, hydrodemetallation, wherein the main object is to remove metals from hydrocarbons using hydrogen as a reactant; additionally, other elements, such as arsenic, may be removed, as note U.S. Pat. No. 4,046,674 to Young, herein incorporated by reference in its entirety. Yet another hydroprocessing method involves the hydrogenation of unsaturated organic compounds to saturated products, with still other known forms of hydroprocessing including hydroisomerization, hydrodealkylation, hydroreforming, etc. These and any other processes wherein hydrogen is reacted with a hydrocarbonaceous fluid are considered herein to be within the definition of the term "hydroprocessing."

The hydroprocessed hydrocarbon feedstock used in this invention may be derived from natural or synthetic sources. The feedstock may be hydroprocessed crude oil or hydroprocessed hydrocarbons derived from oil shale (i.e., hydroprocessed crude shale oil). In particular, hydroprocessed hydrocarbon feedstocks suitable as a lubricating oil or fuel oil will form stable compositions when stabilized in the practice of this invention.

The calcium sulfonates used in this invention are any of a group of petroleum hydrocarbon sulfonates derived from the sulfuric acid treatment of oil and subsequent neutralization with calcium base. The metal sulfonates are often derived from "mahogany" acids (i.e., the mahogany colored petroleum sulfonic acids obtained as a by-product during white oil manufacture, by heating with an excess of a calcium base and water at an elevated temperature). The preferred calcium sulfonates have a total base number (TBN) less than about 350. The total base number is determined by conventional methods of analysis measuring the basic constituents of the material tested. The most preferred calcium sulfonates have a total base number ranging from about 300 to about 350.

Phenates for use in this invention are generally obtained by reacting phenol or a substituted phenol with a metal base. Substituted phenols are generally mono, di, or tri-hydrocarbyl substituted, such as alkyl, alkenyl, aryl, aralkyl or alkaryl. In many instances, phenates contain sulfur, often in the form of a sulfur bridge containing one to four or more sulfur atoms between two phenyl groups. In some cases, several phenols or substituted phenols are bridged together by a number of sulfur bridges. Often, the metal base is a Group II metal in the form of a metal oxide, hydroxide, alcoholate, acetate, and the like. Common metals are calcium, barium, strontium and magnesium. The most suitable metal phenates will be soluble in the hydrotreated liquid hydrocarbon used in this invention. The preferred metal phenates will be the calcium phenates. The most preferred calcium phenates will have a total base number ranging from about 100 to about 300.

The polyalkenylsuccinimides used in this invention have a molecular structure of succinimide represented by the following formula:

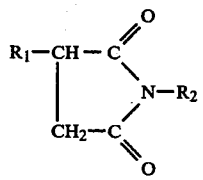

where $R_1$ is an alkenyl radical, i.e., an organic radical containing at least one double bond and from 2 to 200 carbon atoms, and $R_2$ is hydrogen, an alkyl radical usually having from 2 to 50 carbon atoms, an amine radical containing at least one nitrogen and from 1 to 50 carbon atoms, a polyamine radical usually having more than one nitrogen and from 2 to 50 carbon atoms, or a polyalkylsuccinimide containing at least one succinimide and usually from 5 to 100 carbon atoms. The most preferred polyalkenylsuccinimides have a nitrogen content ranging from about 0.20 to about 4.0 percent of the total polyalkenylsuccinimide weight.

A polyol ester is a compound having more than one organic ester, which is exemplified by a pentaerythritol having more than one organic ester and being represented by the following formula:

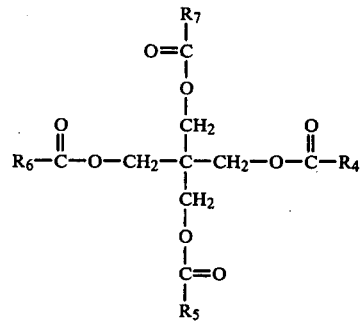

where the four groups, $R_4$, $R_5$, $R_6$, and $R_7$, are the same or different alkyl radicals usually containing 1 to 50 carbon atoms, alkenyl radicals usually having from 2 to 50 carbon atoms, aryl radicals often containing from 6 to 60 carbon atoms, aralkyl radicals usually having from 6 to 60 carbon atoms, or alkylaryl radicals often containing from 6 to 60 carbon atoms. (One useful pentaerythritol is manufactured by The Lubrizol Corporation under the trade designation Lubrizol No. 936.) The most suitable polyol esters are soluble in the hydrotreated liquid hydrocarbons to be stabilized in the practice of this invention.

The aforementioned additives or a combination of the additives can be effectively employed in any concentration which is sufficient to inhibit sediment formation to at least some degree. In many instances each additive is effectively employed in a concentration between 0.001 to about 2.0 percent by weight of the total oil and additive mixture. An effective combination of one or more additives of the invention is present in a concentration of at least 0.001 percent by weight of the total oil-additives weight. A preferred oil-additives combination contains additives equal to a range of about 0.01 to about 0.3 percent by weight of the total oil-additives weight.

The additives used in this invention are intimately mixed with the hydroprocessed liquid hydrocarbon by any suitable method, as for example, in a batch process or by addition to a process stream. The additives may be added to the liquid hydrocarbon either individually or as a combined system. The treated hydrocarbon may be immediately utilized in its intended application, or it may be satisfactorily stored for extended periods of time and thereafter utilized in the desired application.

In the case of addition to a process stream, the additives are usually injected into the stream by the use of a suitable liquid injection pump. Suitable flow rates for the liquid hydrocarbon into which the additives are injected vary from between about 100 gallons per minute to about 300 gallons per minute. Most desirably the viscosity of the liquid hydrocarbon is suitably low, to assure adequate mixing of the additives. To accomplish this, hydrocarbons in the process stream should be at a temperature in the range of about ambient temperature to about 135° C.

In an alternative method of addition, a hydrotreated or hydrodewaxed hydrocarbon is added to a suitable mixing vessel such as a batch reactor. Typically, the mixing vessel is equipped with a motorized stirrer or agitator which assures thorough mixing of all components. The delivery of the additives may be intermittent, or all of the additives may be delivered at once. The viscosity of the liquid hydrocarbon is usually kept reasonably low to assure adequate mixing. For this reason the temperature of the liquid hydrocarbon should not fall below about ambient temperature. The highest temperature at which the mixing is performed should not exceed about 135° C. to avoid excess heat degradation of the hydrocarbon components. Mixing should be continued until the additives are uniformly distributed throughout the liquid hydrocarbon. Most suitably, the duration of mixing will range from about 15 minutes to about 1 hour, depending on the efficiency of the mixing apparatus.

This invention is most advantageously applied to hydrocarbons derived from oil shale. Oil shale-derived hydrocarbons are often subjected to any of a variety of hydroprocessing treatments, as for example, hydrotreating to remove sulfur and nitrogen, hydrodewaxing to lower the pour point, hydrodearseniting and the like. The numerous refining processes to which shale syncrude is subjected greatly increases the instability of the syncrude. For example, shale oil syncrude which has been hydrotreated and hydrodewaxed will often be found to form sediment upon exposure to sunlight in less than 18 hours. In the practice of this invention, however, it will be found that sediment can be inhibited from forming for at least 7 days, often for at least 80 days. In some cases, compositions of the invention will not sediment for over 105 days.

In the following Examples, a method for practicing the present invention, and a comparison illustrating the efficacy of the invention are presented. The Examples, however, are not to be construed as limiting the scope of the invention, which is defined by the claims.

EXAMPLE I

In this Example, a sample of treated shale oil syncrude, which had been obtained by retorting oil shale and deashing, dearseniting, hydrotreating, and hydrodewaxing, the resultant crude shale oil, is subjected to actinic energy so as to serve as a control for a series of experiments comparing the efficacy of several additives in preventing or inhibiting sedimentation.

Ten grams of the treated shale oil syncrude (+25° pour point having a full boiling range of 100° F. to 1,000° F.) is added to a 6 dram vial. The vial is capped, shaken, and placed on a northerly facing window sill. In a separate sediment formation test, 3 ml of oil are placed in a quartz glass cuvette and set in a Schoeffel Instrument Corporation LH151N lamp housing equipped with a 1,000 watt DC Xenon compact arc lamp (Hanovia 976C-1) with a light intensity of 42.5 milliwatts/cm$^2$. The material is viewed periodically, and the number of days of exposure required to form a visual sediment is recorded.

The syncrude sample placed on the window sill forms sediment within two days, and the sample exposed to radiation from the Schoeffel lamp forms sediment within fifty minutes.

EXAMPLE II

In this Example, samples of the same treated shale oil syncrude as used in Example I are mixed with calcium sulfonates of various total base numbers (TBN). The procedure of Example I is repeated with the exception that a weighed amount of material to be evaluated is mixed with the required amount of syncrude to prepare a sample with a total weight of ten grams. In this instance only sample No. 12 is exposed to radiation from the Schoeffel lamp. The results are summarized in Table I. For comparison purposes, the results obtained for the control sample described in Example I are also presented in Table I.

TABLE I

| Sample No. | Additive | Additive Concentration Wt. % | Time To Form Sediment (Days) Sun Light | Time To Form Sediment (Minutes) Schoeffel Lamp |
|---|---|---|---|---|
| 2 | Control (Syncrude +25° F. pour point) | 0 | 2 | 50 |
| 12 | Calcium sulfonate TBN 320 | 0.1 | 105 No sed. | 180 No sed. |
| 40 | Calcium sulfonate TBN 24 | 0.1 | 12 | — |
| 39 | Calcium sulfonate TBN 300 | 0.2 | 22 No sed. | — |
| 34 | Calcium sulfonate TBN 24 | 0.3 | 50 No sed. | — |
| 25 | Calcium sulfonate TBN 400 | 0.4 | 7 | — |
| 24 | Calcium sulfonate TBN 300 | 0.5 | 20 | — |

No sed. — indicates that no sediment was observed within the stated time.

The results shown in Table I indicate that calcium sulfonates inhibit or prevent light-induced sedimentation, and that calcium sulfonates with a TBN ranging from 300 to 350 are particularly effective in inhibiting or preventing sedimentation.

EXAMPLE III

In this Example, samples of the same treated shale oil syncrude are mixed with calcium phenates of varying total base number. The procedure is the same as that described in Example II. In this instance only Sample Nos. 30 and 31 are exposed to radiation from the Schoeffel lamp. The results are summarized in Table II. For comparison purposes, the results obtained for the control sample described in Example I are also presented in Table II.

TABLE II

| Sample No. | Additive | Additive Concentration Wt. % | Time To Form Sediment (Days) Sun Light | Time to Form Sediment (Minutes) Schoeffel Lamp |
|---|---|---|---|---|
| 2 | Control (Syncrude +25° F. pour point) | 0 | 2 | 50 |
| 30 | Calcium phenate TBN 150 | 0.2 | 13 | 150 |
| 38 | Calcium phenate TBN 200 | 0.3 | 9 | — |
| 31 | Calcium phenate TBN 260 | 0.3 | 15 | 170 |

The results shown in Table II indicate that calcium phenates effectively inhibit or prevent light-induced sedimentation.

EXAMPLE IV

In this Example, samples of the same treated shale oil syncrude used in Example I are mixed with polyalkenylsuccinimides of varying nitrogen contents. The procedure is the same as that described in Example II, except that none of the samples containing a polyalkenylsuccinimide are exposed to radiation from the Schoeffel lamp. The results are summarized in Table III, compared against the results obtained for the control sample described in Example I.

TABLE III

| Sample No. | Additive | Additive Concentration Wt. % | Time to Form Sediment (Days) Sun Light |
|---|---|---|---|
| 2 | Control (Syncrude +25° .F pour point) | 0 | 2 |
| 41 | Polyalkenylsuccinimide, 2.0 wt % nitrogen | 0.1 | 22 No sed. |
| 42 | Polyalkenylsuccinimide, 2.3 wt % nitrogen | 0.1 | 22 No sed. |
| 28 | Polyalkenylsuccinimide, 0.35 wt % nitrogen | 0.4 | 80 No sed. |
| 26 | Polyalkenylsuccinimide, 1.0 wt % nitrogen | 0.5 | 80 No sed. |
| 27 | Polyalkenylsuccinimide, 1.8 wt % nitrogen | 1.0 | 80 No sed. |

As shown in Table III, polyalkenylsuccinimides effectively inhibit or prevent sedimentation caused by exposure to sunlight.

EXAMPLE V

In this Example, a sample of the same treated shale oil syncrude as used in Example I is mixed with a pentaerythritol. This pentaerythritol is a type of polyol ester. The procedure of Example I is repeated with the exception that a weighed amount of pentaerythritol is mixed with the required amount of syncrude to prepare a sample which contains 0.4 weight percent polyol ester (added in the form of a product manufactured by The Lubrizol Corporation under the trade designation Lubrizol 936) and a total weight of 10 grams, and the sample is not exposed to radiation from the Schoeffel lamp.

The polyol ester is observed to inhibit or prevent light induced sediment formation for 51 days or more when the source of actinic energy is sunlight.

EXAMPLE VI

In this Example, samples of the same treated shale oil syncrude as used in Example I are mixed with numerous additives to test the effectiveness of the additives to inhibit or prevent sediment formation. The procedure is the same as that described in Example II. In this instance, sample Nos. 32 and 33 are not exposed to sunlight, and sample Nos. 16, 45, 43, 44, 35 and 37 are not exposed to radiation from the Schoeffel lamp. The results are summarized in Table IV. For comparison purposes, the results obtained for the control sample described in Example I are also presented in Table IV.

TABLE IV

| Sample No. | Additive[a] | Additive Concentration Wt. % | Time to Form Sediment (Days) Sun Light | Time to Form Sediment (Minutes) Schoeffel Lamp |
|---|---|---|---|---|
| 2 | Control (Syncrude +25° F. pour point) | 0 | 2 | 50 |
| 3 | Dilaurylthioipropionate | 0.1 | 2 | 30 |
| 4 | Sym. dibetanaphyhyl-p-phenylenediamine | 0.1 | 2 | 30 |
| 5 | 2-hydroxy-4-methoxy-benzophenone | 0.1 | 2 | 42 |
| 6 | Bisphenolic phosphite | 0.1 | 5[a] | 150 |
| 7 | Zinc di-n-butyldithiocarbamate | 0.1 | 2 | 30 |
| 8 | Distearyl pentaerythritol diphosphite | 0.1 | 2 | 60 |
| 9 | Styrene | 0.1 | 5[a] | 50 |
| 11 | Triethylamine | 0.1 | 2 | 50 |
| 32 | 4,4' butylidene bis (6-tert-butyl-meta-cresol) | 0.5 | — | 50 |
| 33 | 4,4' thiobis (6-tert-butyl-meta-cresol) | 0.5 | — | 70 |
| 14 | 4-Butyl-aniline | 1.0 | 1 | 45 |
| 15 | Tetraline | 1.0 | 1 | 45 |
| 16 | Pyrrole | 1.0 | 1 | — |
| 17 | 2,4-dimethylaniline | 1.0 | 1 | 50 |
| 13 | Zinc dialkyldithiophosphate | 0.1 | 1 | 35 |
| 45 | Zinc dialkyldithiophosphate | 0.1 | 1 | — |
| 43 | Zinc dialkyldithiophosphate | 0.2 | 1 | — |

TABLE IV-continued

| Sample No. | Additive[a] | Additive Concentration Wt. % | Time to Form Sediment (Days) Sun Light | Time to Form Sediment (Minutes) Schoeffel Lamp |
|---|---|---|---|---|
| 44 | Zinc dialkyldithiophosphate | 0.2 | 1 | — |
| 35 | Zinc dialkyldithiophosphate | 0.3 | 1 | — |
| 37 | Zinc dialkyldithiophosphate | 0.4 | 1 | — |

[a]haze formed after one day

As shown in Table IV, none of the materials tested proved to be effective in inhibiting or preventing light induced sediment formation in hydrotreated syncrude.

Although the invention has been described by reference to several embodiments, including a preferred embodiment thereof, together with examples relating to preparation methods suitable for producing the compositions of the invention, it is not intended that the invention be limited to the disclosed embodiments or examples. Obviously, many variations, modifications, combinations and alternatives of the invention as described will be apparent to those skilled in the art. Accordingly, the invention is intended to embrace all such variations, modifications, alternatives, and combinations which fall within the spirit and scope of the appended claims.

I claim:

1. A composition comprising (1) a major amount of hydroprocessed liquid hydrocarbon, said hydrocarbon being subject to light-induced sediment formation, and (2) a stabilizing additive comprising a polyol ester.

2. The composition defined in claim 1 wherein said stabilizing additive is present in a concentration between about 0.001 to about 2.0 percent by weight of said composition.

3. The composition defined in claim 1 wherein said hydroprocessed liquid hydrocarbon has been hydrodewaxed.

4. The composition defined in claim 1 wherein said hydroprocessed liquid hydrocarbon has been hydrocracked.

5. A composition comprising (1) a major amount of hydrotreated liquid hydrocarbon, said hydrocarbon being subject to light-induced sediment formation, and (2) a stabilizing additive comprising a polyol ester having a pentaerythritol structure.

6. The composition defined in claim 5 wherein said stabilizing additive is present in a concentration equal to about 0.001 to about 2.0 percent by weight of said composition.

7. The composition defined in claim 5 wherein said hydrotreated liquid hydrocarbon has been hydrodewaxed.

8. A composition comprising (1) a major amount of hydroprocessed liquid hydrocarbon derived from oil shale, said hydrocarbon being subject to light-induced sediment formation and (2) a stabilizing additive selected from the group consisting of calcium sulfonates, metal phenates, polyalkenylsuccinimides, polyol esters, and mixtures thereof.

9. The composition defined in claim 8 wherein said stabilizing additive comprises metal phenates present as calcium phenates, barium phenates, magnesium phenates, and mixtures thereof.

10. The composition defined in claim 8 wherein said stabilizing additive comprises metal phenates present as calcium phenates having a total base number less than about 300.

11. The composition defined in claim 8 wherein said stabilizing additive comprises metal phenates present as calcium phenates having a total base number ranging from about 100 to about 300.

12. The composition defined in claim 8 wherein said stabilizing component comprises calcium sulfonates having a total base number equal to less than about 350.

13. The composition defined in claim 8 wherein said stabilizing component comprises calcium sulfonates having a total base number equal to about 300 to about 350.

14. The composition defined in claim 8 wherein said stabilizing additive comprises polyalkenylsuccinimides having a nitrogen content equal to about 0.20 to about 4.0 percent of the total weight of the polyalkenylsuccinimide components.

15. The composition defined in claim 8 wherein said stabilizing additive is present in a concentration equal to about 0.001 to about 2.0 percent by weight of said composition.

16. The composition defined in claim 8 wherein said hydroprocessed liquid hydrocarbon has been hydrocracked.

17. A composition comprising (1) a major amount of hydroprocessed liquid hydrocarbon derived from oil shale, subject to hydrotreating followed by hydrodewaxing, said hydrocarbon being subject to light-induced sediment formation, and (2) a stabilizing additive selected from the group consisting of calcium sulfonates having a total base number less than about 350, calcium phenates, polyalkenylsuccinimides, polyol esters, and mixtures thereof.

18. The composition defined in claim 17 wherein said stabilizing additive comprises calcium sulfonates having a total base number between about 300 to about 350.

19. The composition defined in claim 17 wherein said stabilizing additive comprises calcium phenates having a total base number between about 100 to about 300.

20. The composition defined in claim 17 wherein said stabilizing additive is present in a concentration equal to about 0.001 to about 2.0 percent by weight of said composition.

21. A method of stabilizing a hydroprocessed liquid hydrocarbon against light-induced sediment formation comprising combining with said hydroprocessed liquid hydrocarbon a polyol ester.

22. The method defined in claim 21 wherein said polyol ester is present in a concentration equal to about 0.001 to about 2.0 percent by weight of the combination of said hydroprocessed liquid hydrocarbon and said polyol ester.

23. The method defined in claim 21 wherein said polyol ester comprises a pentaerythritol structure.

24. A method of stabilizing a hydrotreated liquid hydrocarbon derived from oil shale against light-induced sediment formation comprising combining with said hydroprocessed liquid hydrocarbon a stabilizing additive selected from the group consisting of calcium sulfonates, polyalkenylsuccinimides, metal phenates, polyol esters, and mixtures thereof.

25. The method defined in claim 24 wherein said stabilizing additive comprises calcium sulfonates having a total base number less than about 350.

26. The method defined in claim 24 wherein said stabilizing additive comprises metal phenates present as calcium phenates, barium phenates, magnesium phenates, and mixtures thereof.

27. The method defined in claim 24 wherein said stabilizing additive comprises polyalkenylsuccinimides having a nitrogen content equal to about 0.20 to about 4.0 percent of the total weight of the polyalkenylsuccinimide components.

28. The method defined in claim 24 wherein said stabilizing additive is present in a concentration equal to about 0.001 to about 2.0 percent by weight of the combination of said hydroprocessed liquid hydrocarbon and said stabilizing additive.

* * * * *